US012708196B2

(12) United States Patent
Fujimoto et al.

(10) Patent No.: US 12,708,196 B2
(45) Date of Patent: Aug. 18, 2026

(54) COSMETIC APPLICATOR

(71) Applicant: MITSUBISHI PENCIL COMPANY, LIMITED, Tokyo (JP)

(72) Inventors: Kota Fujimoto, Fujioka (JP); Hayato Ohta, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 19/037,446

(22) Filed: Jan. 27, 2025

(65) Prior Publication Data

US 2025/0241437 A1 Jul. 31, 2025

(30) Foreign Application Priority Data

Jan. 31, 2024 (JP) ..... 2024-013521

(51) Int. Cl.
*A46B 11/00* (2006.01)
*A45D 34/04* (2006.01)
*A46B 9/02* (2006.01)

(52) U.S. Cl.
CPC ..... *A46B 11/0072* (2013.01); *A45D 34/042* (2013.01); *A46B 9/021* (2013.01); *A46B 11/001* (2013.01); *A46B 2200/1046* (2013.01)

(58) Field of Classification Search
CPC ..... A46B 2200/1046; A46B 11/0082; A46B 9/021; A46B 9/026; A45D 34/042; A45D 2200/053
See application file for complete search history.

(56) References Cited

U.S. PATENT DOCUMENTS 12,369,699 B2 * 7/2025 Sakai ..... A46B 9/021

FOREIGN PATENT DOCUMENTS

| | | | | |
|---|---|---|---|---|
| CN | 105592749 B | * | 1/2020 | ..... A45D 40/265 |
| JP | 2006087753 A | * | 4/2006 | |
| JP | 2018-192242 A | | 12/2018 | |
| JP | 2018-192673 A | | 12/2018 | |
| JP | 2021-112692 A | | 8/2021 | |

* cited by examiner

*Primary Examiner* — Jennifer C Chiang

(74) *Attorney, Agent, or Firm* — Oblon, McClelland, Maier & Neustadt, L.L.P.

(57) ABSTRACT

A cosmetic applicator may be capable of stably applying an application liquid without clogging the application member composed of a brush tip with particles contained in the application liquid. The front barrel may be made of a transparent material and the tip of the brush tip may be arranged to protrude from the front barrel through the front end opening of the front barrel while the brush tip is mounted inside the front barrel. A clearance may be formed between the front end opening of the front barrel and the brush tip, which allows the brush tip in the front barrel to also be deflected and deformed along with the deflection and deformation of the brush tip based on the application operation of the application liquid by the brush tip.

20 Claims, 9 Drawing Sheets

COSMETIC APPLICATOR

CROSS-REFERENCE TO RELATED APPLICATIONS

The present application claims the benefit of the filing date of Japanese Appl. No. 2024-013521, filed on Jan. 31, 2024, the content of each of which is incorporated by reference.

TECHNICAL FIELD

This invention relates to a cosmetic applicator, such as an eyeliner, that uses a brush tip as a cosmetic application member.

BACKGROUND ART

In an applicator such as an eyeliner which uses a brush tip as an application member for a cosmetic, the brush tip is typically arranged projecting from the front end of a barrel, a collector having a comb shape is provided for temporarily holding an application liquid to be supplied to the brush tip, and a configuration is used in which a container of the application liquid is provided at the rear of the barrel and the application liquid in the container of the application liquid can be supplied to the collector and the brush tip. This configuration is disclosed in Patent Literature 1 and Patent Literature 2.

In recent years, there has been a growing need for eyeliners that contain an application liquid containing large-diameter solids such as glitter (metallic powder) to add gloss to makeup, and with the conventional makeup applicator disclosed in Patent Literature 1 and Patent Literature 2, the aforementioned large-diameter solids can clog in the flow channel, causing problems that make it difficult to smoothly apply the application liquid.

In order to solve the aforementioned problem, Patent Literature 3 discloses the adoption of a cylindrical relay core having a plurality of circumferential grooves along the axial direction between the application liquid container and the brush tip as the application member.

The circumferential grooves along the axis of this relay core are characterized by the fact that the depth of the grooves through which the application liquid passes, which are arranged adjacent to each other in the circumferential direction of the relay core, alternately changes, and it is stated that the relay core with this circumferential groove can supply the application liquid from the application liquid container to the brush tip without clogging the large-diameter solids in the application liquid.

CITATION LIST

Patent Literature

PTL 1: JP-A-2018-192242
PTL 2: JP-A-2018-192673
PTL 3: JP-A-2021-112692

SUMMARY OF INVENTION

Technical Problem

The cosmetic applicator disclosed in Patent Literature PTL 3 was developed with focusing on the problem of particles of the application liquid as a liquid cosmetic clogging in the relay core of the liquid cosmetic supplied from the liquid container to the brush tip. However, the inventors of this application have verified that the problem of clogging by the particles in the application liquid also occurs in the brush tip formed by bundling thin fibers that function as an application member, and countermeasures for this were identified as a problem to be solved.

This invention was made with a focus on the problem of clogging of particles in the application liquid as a liquid cosmetic in the brush tip through which the application liquid is applied, and the main purpose is to provide an applicator that can stably apply the application liquid without clogging the application member composed of the brush tip with the aforementioned particles, even when the application liquid contains large particles.

Solution to Problem

A cosmetic applicator according to the present invention to solve the aforementioned problem includes a barrel composed of a front barrel and a rear barrel,

- an application member using a brush tip made of a bundle of fibers on a front barrel side of the barrel,
- an application liquid as a liquid cosmetic, and
- an application liquid reservoir containing the application liquid, disposed on the rear barrel of the barrel, and configured to be able to supply the application liquid contained in the application liquid reservoir to the brush tip, wherein the front barrel is made of a transparent material, and the brush tip is mounted within the front barrel, a tip portion of the brush tip is arranged to protrude from the front barrel through a front end opening of the front barrel, and a clearance is formed between the front end opening of the front barrel and the brush tip, allowing the brush tip in the front barrel to also be deflected and deformed together with the deflection deformation of the brush tip due to the application operation of the application liquid with the brush tip.

According to the present invention, by making the deflection deformation of the brush tip larger than the conventional one when the brush tip is pressed against the application surface during application, especially when using a liquid containing large particles whose diameter exceeds 10 μm as an application liquid, the large particles in the brush tip can cause relative shearing to the fibers of the brush tip along with deflection deformation of the brush tip, thereby preventing the particles from sticking to the brush tip or sticking to each other. The term "transparent material for the front barrel" as used herein refers to a material whose interior can be seen through, e.g., translucent, and does not refer to a material that has a transmittance of 100%.

It is also preferable for the cosmetic applicator to satisfy the following conditions:

$$1\ \text{mm} \leq D2 < D1 \leq 3\ \text{mm}, \quad (1)$$

$$0.25 \leq D3, \quad (2)$$

where the diameter of the front end opening of the front barrel at the inner diameter is D1, the outer diameter of the brush tip located at the front end opening of the front barrel is D2, and the ratio of the difference between D1 and D2 to D2 is D3, i.e., D3=(D1−D2)/D2.

In addition, as the condition (3), it is preferred that the ratio of the void area, Sr, which is the ratio of the cross-sectional area of the hollow portion formed at the brush tip, Sb, to the cross-sectional area, Sa, surrounded by the outer circumference of the brush tip at the outer diameter D2 of the brush tip located at the front end opening of the front barrel, Sa, is 40%<Sr<95%.

Advantageous Effects of Invention

Using the cosmetic applicator according to the present invention, a clearance is formed between the front opening of the front barrel and the brush tip, which allows the deflection deformation of the brush tip to be transferred to the brush tip inside the front barrel along with the deflection deformation of the brush tip due to the application of the application liquid by the brush tip. Therefore, the deflection of the brush tip due to the application operation of the application liquid is transferred through the aforementioned clearance to the brush tip inside the front barrel to cause it to deflect and deform.

As a result, the fibers that make up the brush tip inside the front barrel do not maintain a closely contacting state, and a shear is created between the fibers along with the deflection of the brush tip similar to the front half of the brush tip. Therefore, it is possible to provide a cosmetic applicator that provides stable application operation without causing the brush tip to be clogged with particles in the application liquid.

BRIEF DESCRIPTION OF DRAWINGS

FIG. 1A is a front view and FIG. 1B is a central cross-sectional view along the axis direction.

FIG. 2A is a front view, and FIG. 2B is a central cross-sectional view along the axis direction.

FIG. 3A is a cross-sectional view along the axis and FIG. 3B is an enlarged cross-sectional view at b-b line shown in FIG. 3A.

FIG. 6A is a front view and FIG. 6B is a central cross-sectional view along the axial direction.

FIG. 7A is a perspective view with the front end facing forward, and FIG. 7B is a perspective view with the rear end facing forward.

FIG. 8A is a front view viewed from a slit side, FIG. 8B is a top view rotated by 90 degrees axially against the state of FIG. 8A, and FIG. 8C is a cross-sectional view viewed in the arrow direction from a-a line of FIG. 8A, FIG. 8D is a left side view, and FIG. 8E is a right side view.

FIG. 9A is a view showing the state of a brush tip before application, and FIG. 9B is a view showing the state of the brush tip after application action.

SOLUTION TO PROBLEM

The Cosmetic applicator according to the present invention will be described based on embodiments shown by the drawings.

Figure 1A:
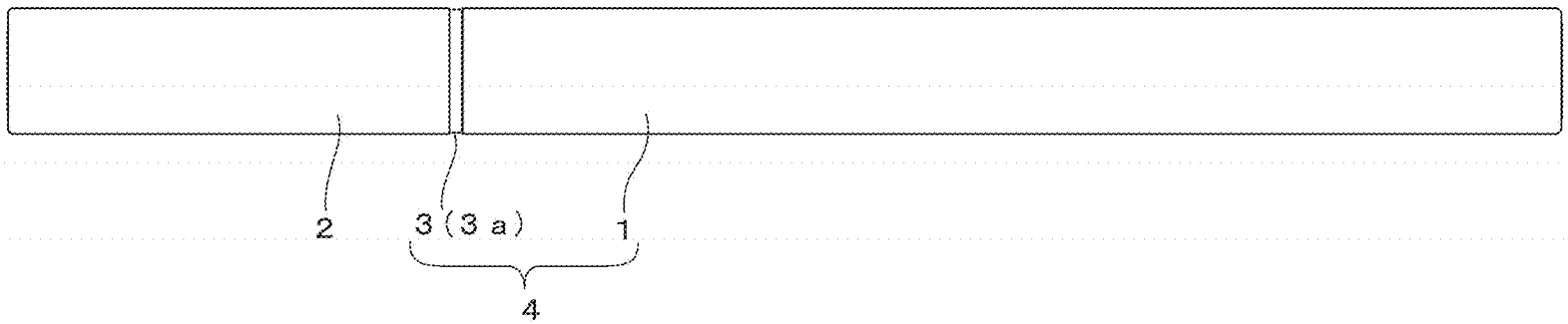
FIGS. 1A and 1B are views illustrating the entire construction of a cosmetic applicator according to the present invention.
Figure 1B:
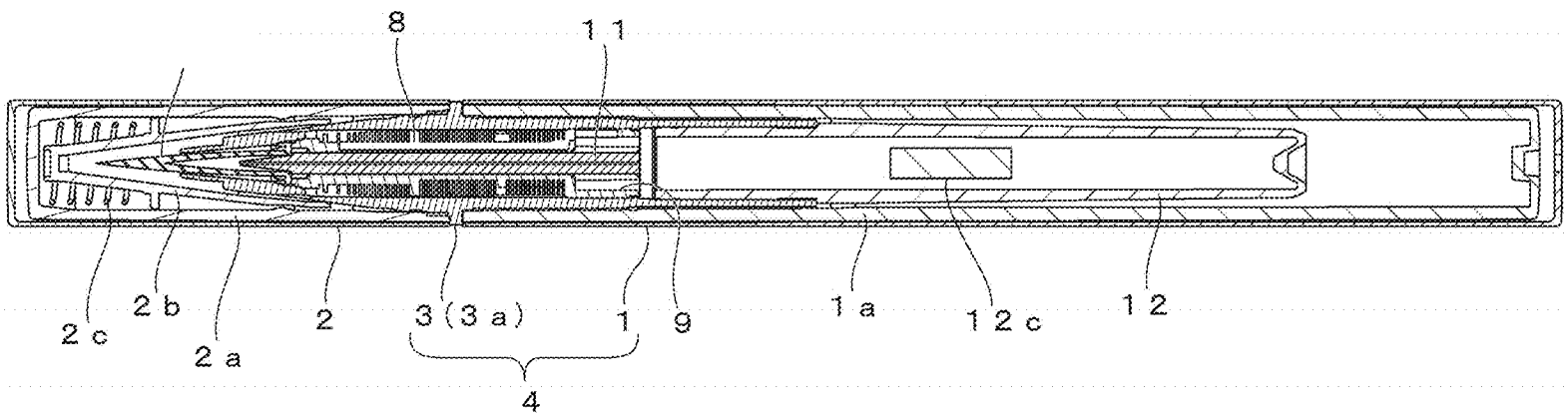
Figure 2A:
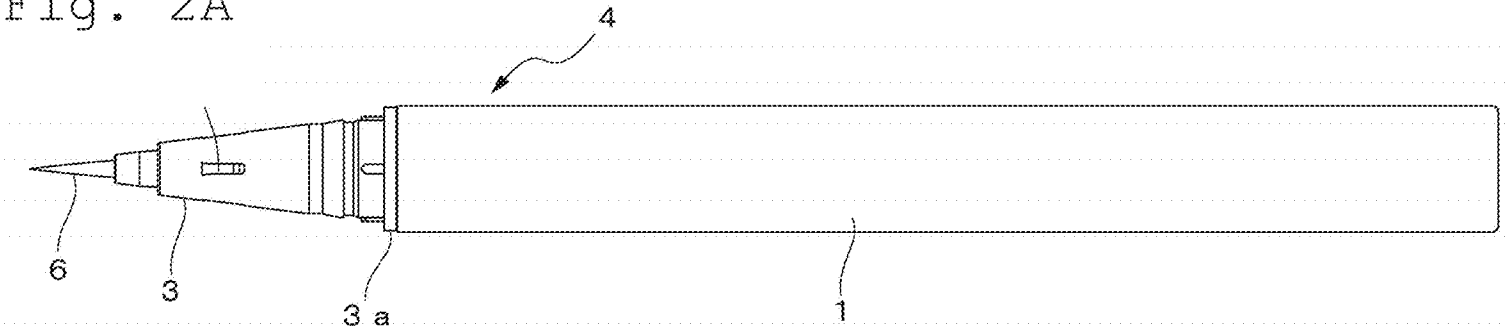
FIGS. 2A and 2B are views showing a state where a cap of the cosmetic applicator is removed.
Figure 2B:
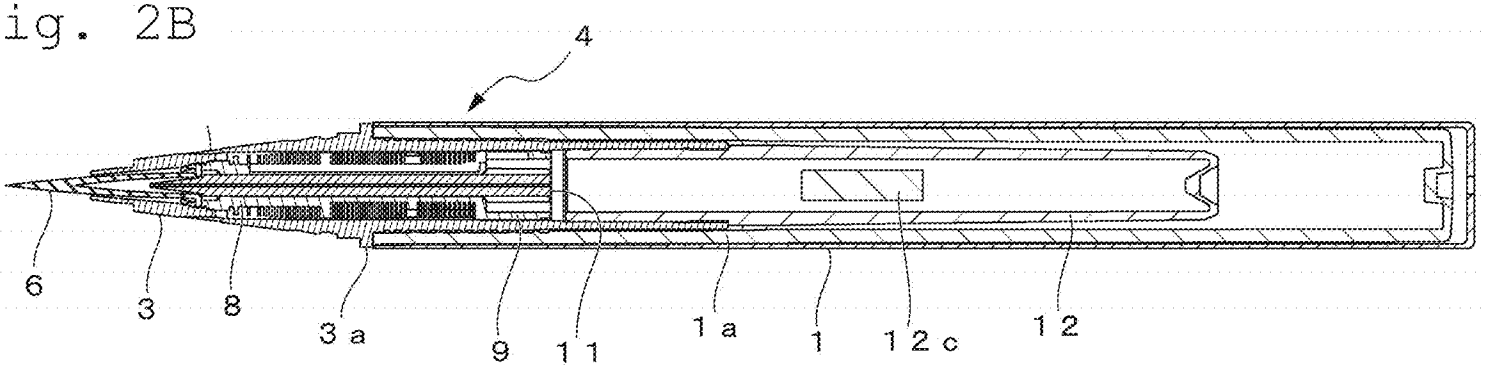
Figure 3A:
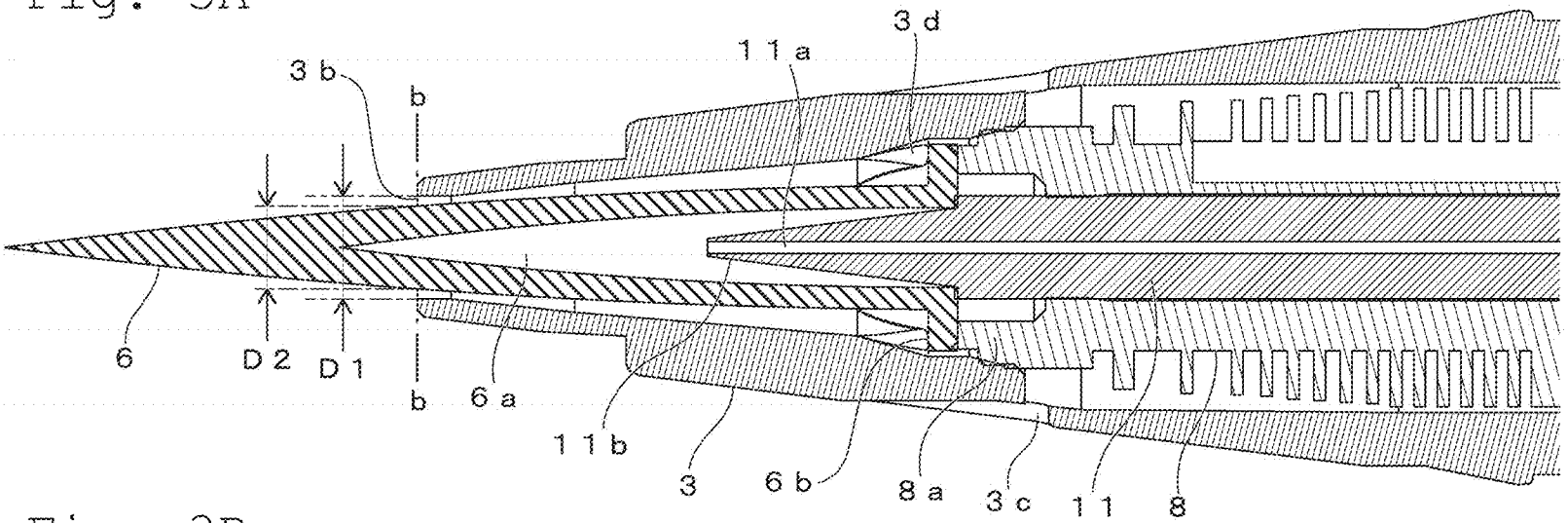
FIGS. 3A and 3B are enlarged cross-sectional views of the front end portion of the cosmetic applicator.
Figure 3B:
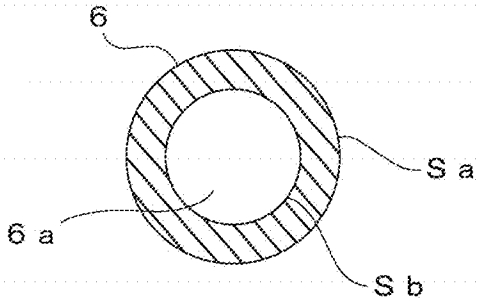
Figure 4:
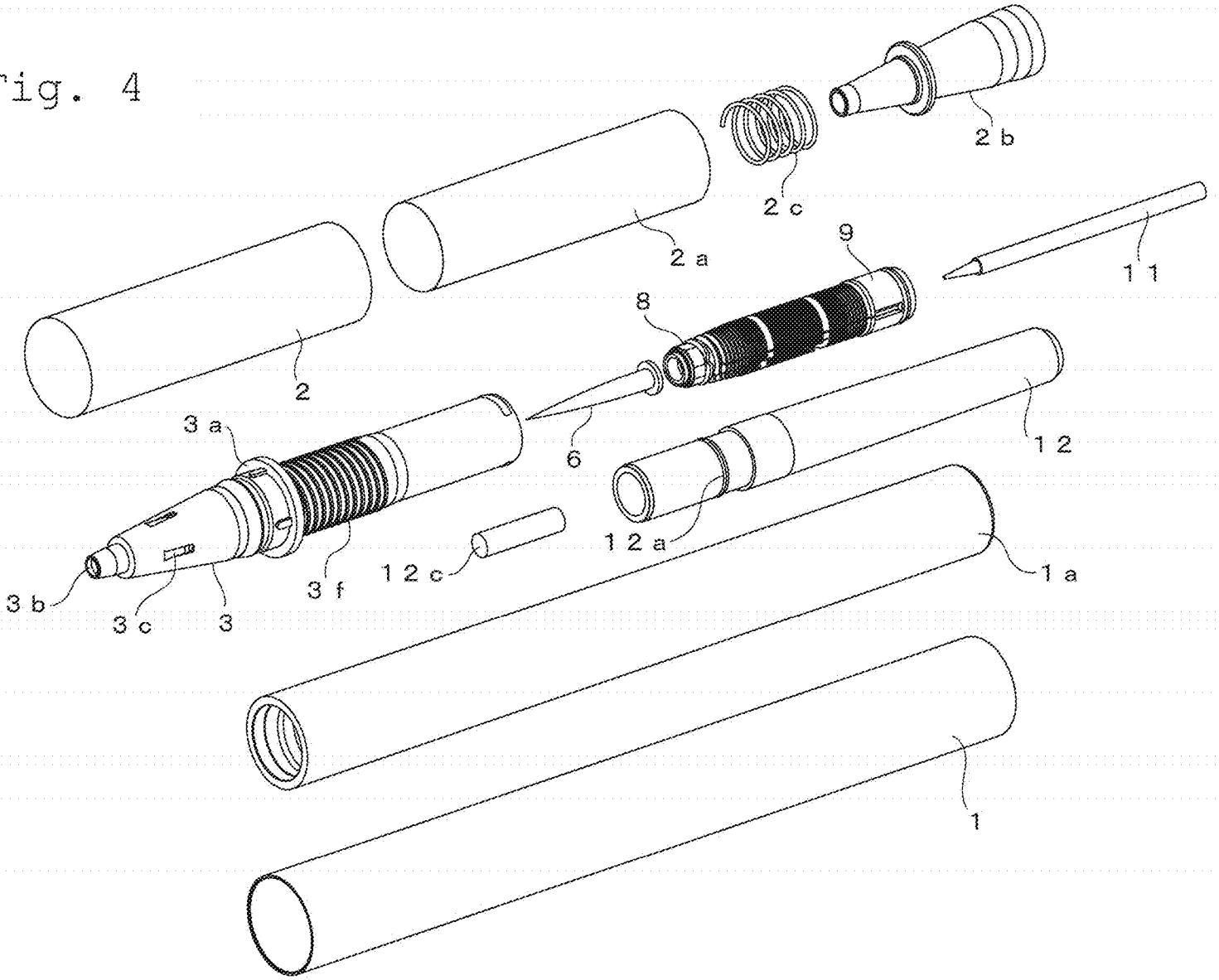
FIG. 4 is a development of parts of the entire cosmetic applicator.
Figure 5:
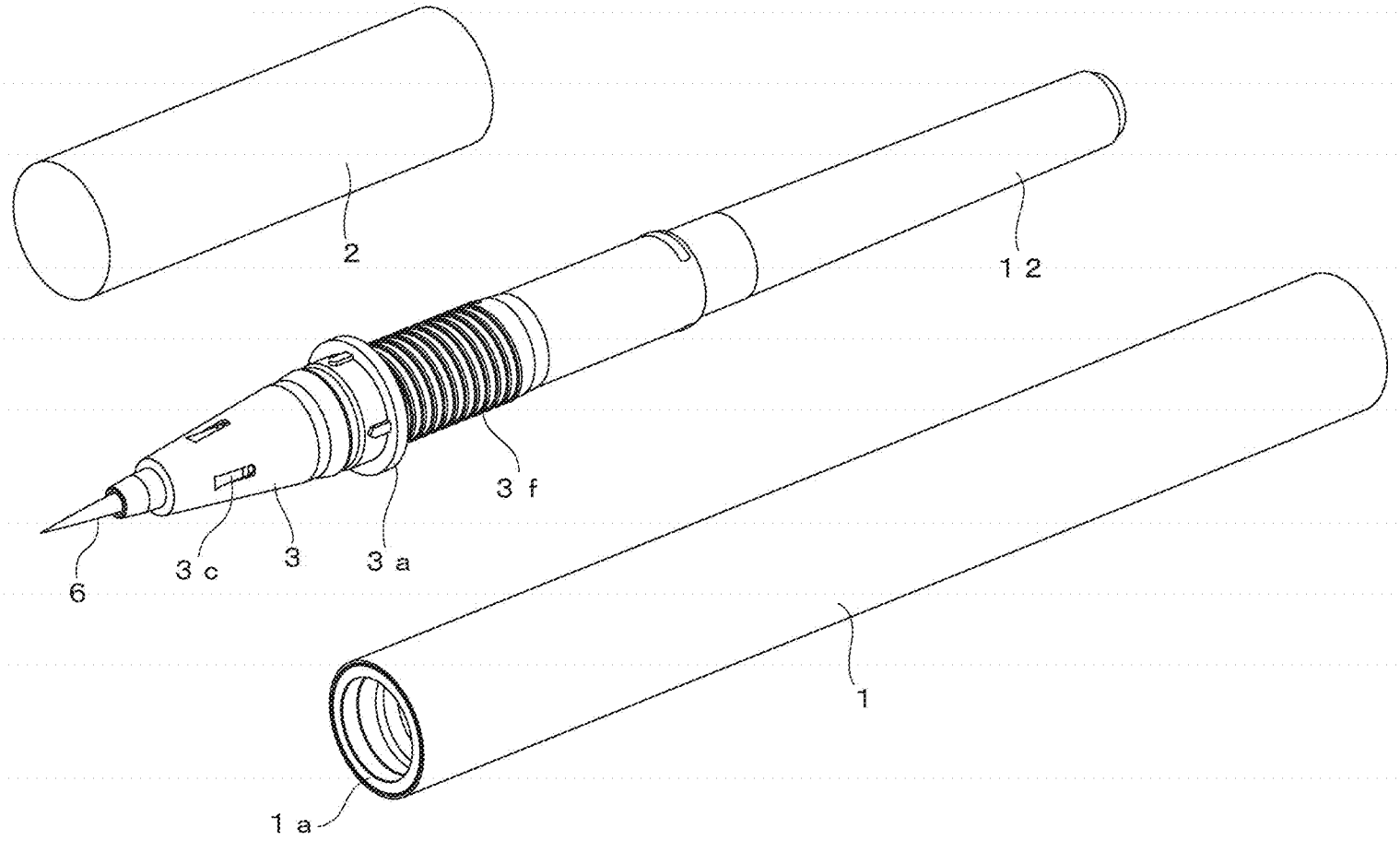
FIG. 5 is a development showing the state where the main parts of the cosmetic applicator are assembled.

FIGS. 1A and 1B show the entire construction of a cosmetic applicator, FIGS. 2A and 2B, and FIGS. 3A and 3B show the state in which the cap is removed, and FIG. 4 is a development of parts.

The cosmetic applicator, as shown in FIGS. 1A and 1B, is formed in a column having a thin-long appearance by connecting a rear barrel 1 formed in a cylindrical shape and the rear end of which is closed, and a cap 2 also formed in a cylindrical shape and the front end of which is closed, in-line in the front-back direction.

The rear barrel 1 has a two-layer structure in which a rear barrel inner layer 1*a* is attached to the inside thereof, and the outside thereof is made of, for example, a thin aluminum alloy or a hard resin material, and the rear barrel inner layer 1*a* is preferably made of resin material.

A front barrel 3 is connected to a front end opening of the rear barrel inner layer 1*a*, thereby forming a barrel 4 with the rear barrel 1 and the front barrel 3. The cap 2 is detachably attached to the front barrel 3 by sandwiching a brim 3*a* formed on the front barrel 3. (See FIG. 1A)

Similar to the rear barrel, the cap 2 has a two-layer structure in which a cap inner layer 2*a* is attached to the inside thereof, and the outside thereof is made of, for example, a thin aluminum alloy or a hard resin material, and the cap inner layer 2*a* is preferably made of resin material.

As shown in FIG. 4, a bowl-like inner cap 2*b* covering for increasing the tightness of the brush tip 6 as an application member to be described later is movably disposed in the axial direction in the cap inner layer 2*a* of the cap 2. In addition, a coil spring 2*c* is mounted between the inner cap 2*b* and the cap inner layer 2*a* and is configured to exert a biasing force on the inner cap 2*b* toward the brush tip 6. (See FIG. 1B)

The front barrel 3, which constitutes the front half of the barrel 4, is equipped and mounted with the main components constituting the cosmetic applicator.

That is, the brush tip 6 formed by bundling fibers is arranged to protrude at the front end of the front barrel 1. At the front end of the front barrel, a collector (a temporary holder) 8 having a plurality of fins which temporarily holds an application liquid as a liquid cosmetic to be supplied to the brush tip 6, an application liquid reservoir 12 located at the rear of the collector 8 which is detachably mounted on the rear part of the front barrel 3, and an application liquid supply pipe 11 which supplies the application liquid in the application liquid reservoir 12 to the brush tip 6 are arranged.

The front barrel 3 and the structure of each component mounted on the front barrel 3 will be separately described below.

Front Barrel 3

Figure 6A:
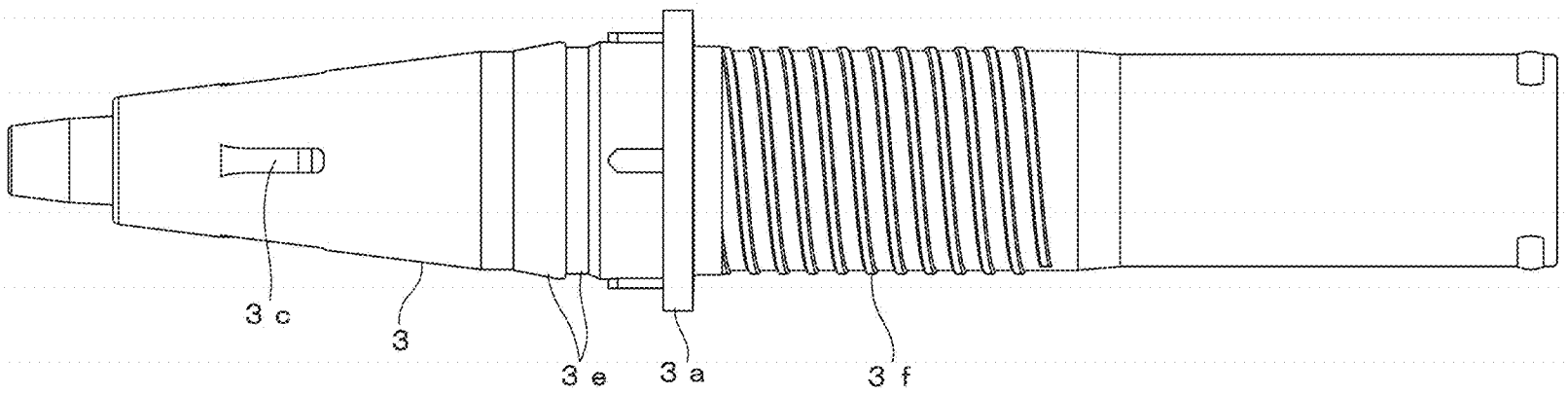
FIGS. 6A and 6B are views showing a single-part structure of a front barrel.
Figure 6B:
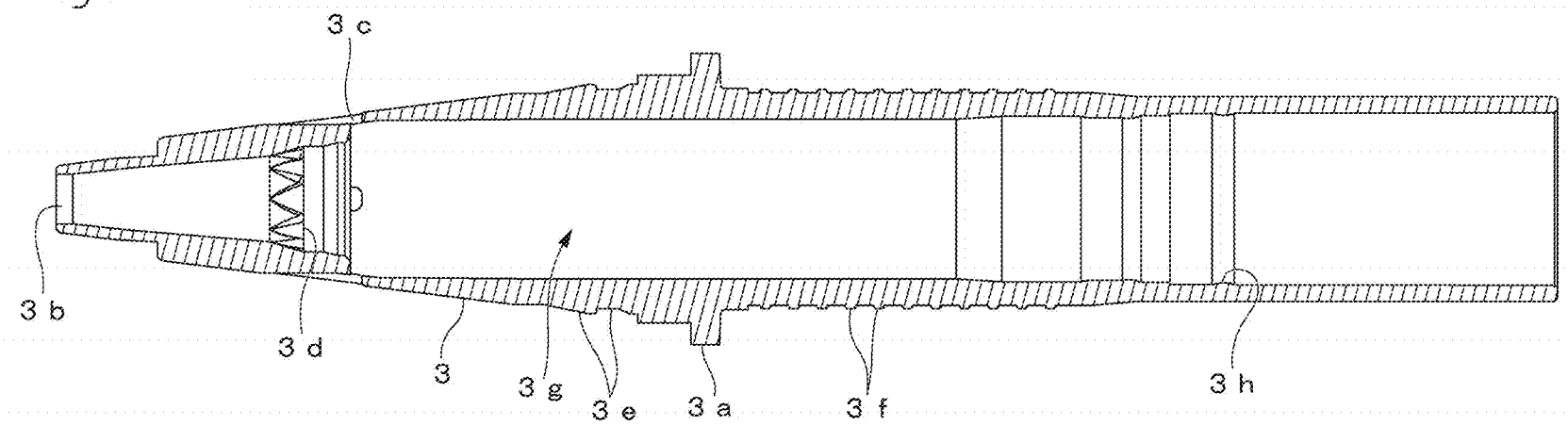
Figure 7A:
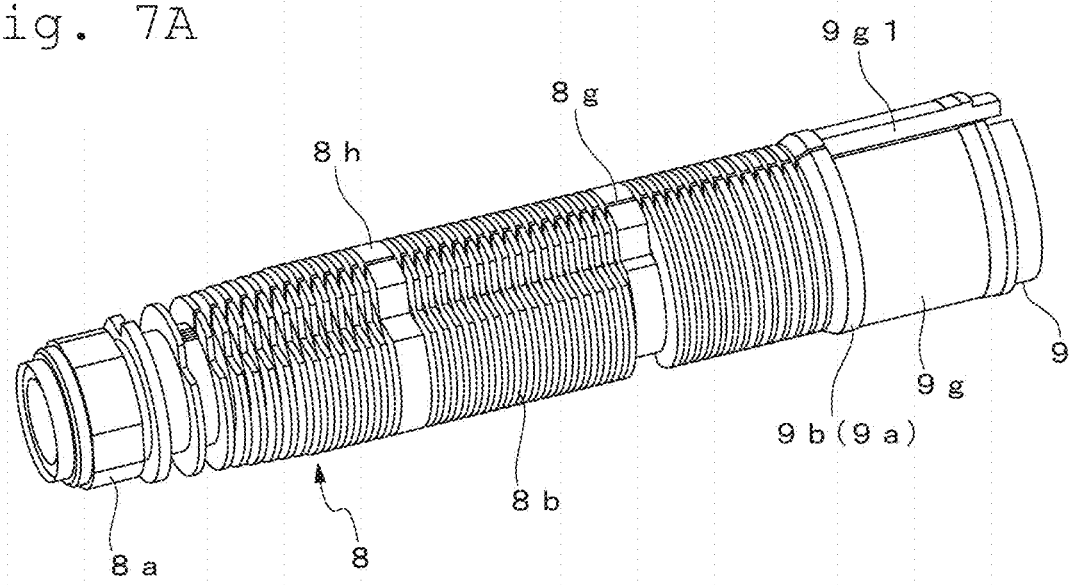
FIGS. 7A and 7B are views showing a single-part structure of a collector.
Figure 7B:
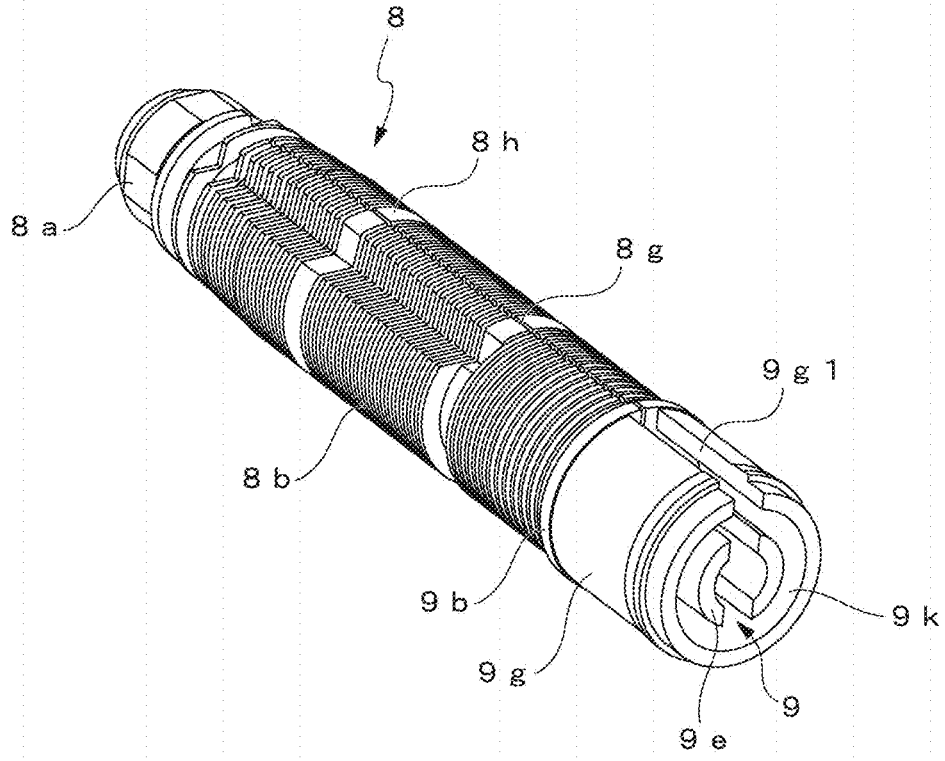
Figure 8A:
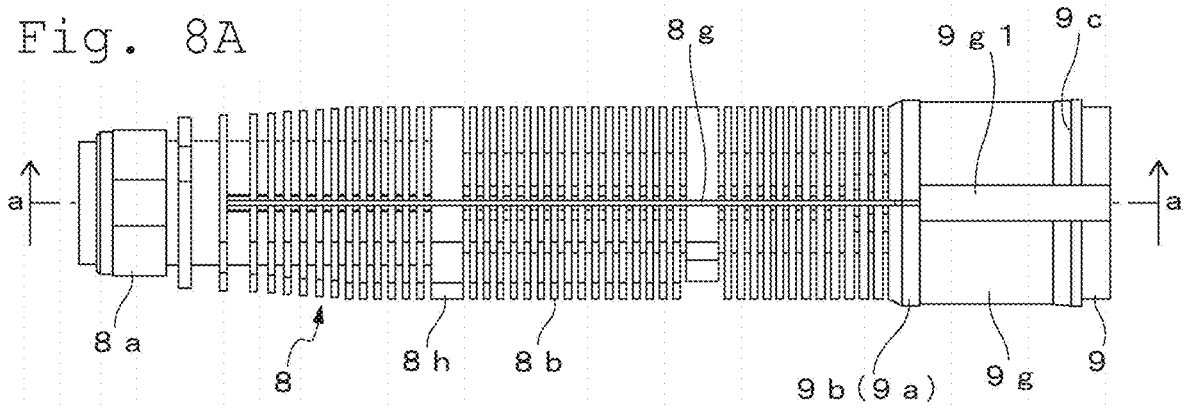
FIGS. 8A to 8E are views showing a single-member structure of a collector.
Figure 8B:
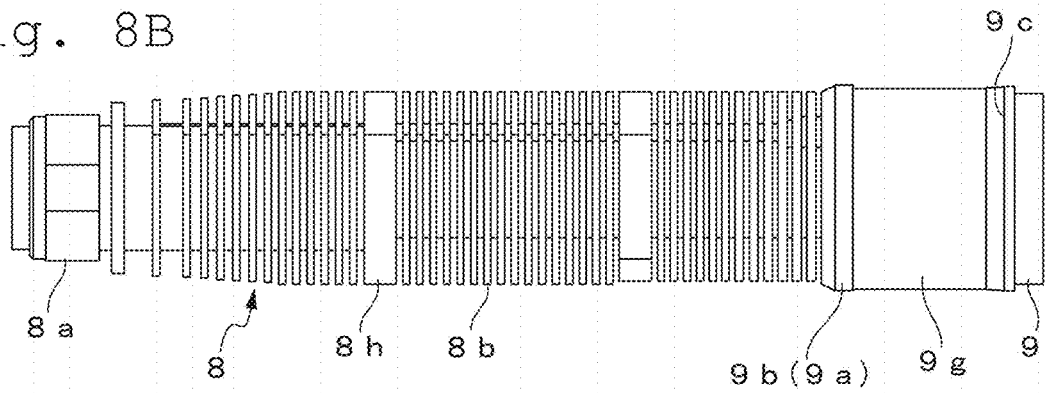
Figure 8C:
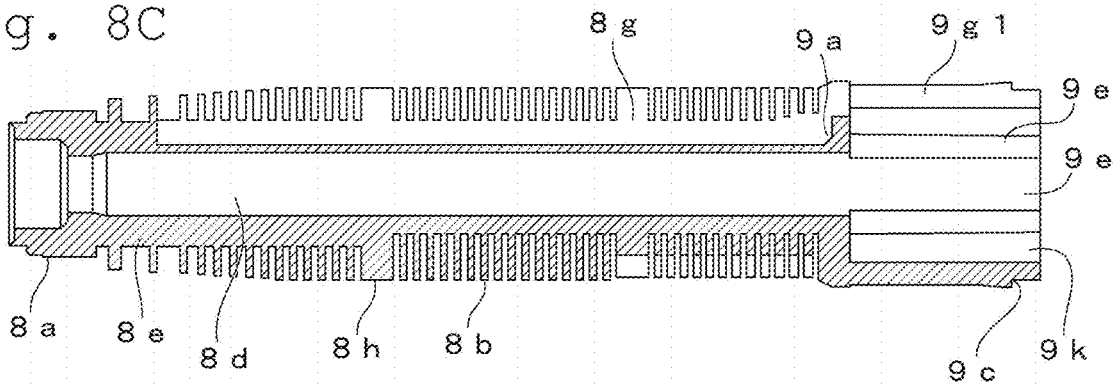
Figure 8D:
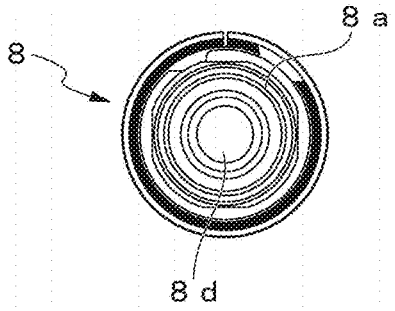
Figure 8E:
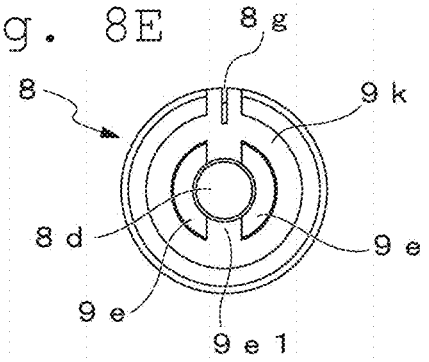

As shown in the single-part structure in FIGS. 6A and 6B, the brim 3*a*, which serves as a positioning guide when the cap 2 is fitted, is formed in the front barrel 3 to protrude toward the outside of the circumference at the central part of the longitudinal direction. The front half of the front barrel 3 from the brim 3*a* is tapered, and the front end opening 3*b* through which the brush tip 6 is extended is formed at the front end thereof.

In addition, a plurality of air vent holes 3*c* (four holes in the illustrated example) are bored and formed to penetrate the circumferential surface at an equal distance along the circumference at the tapered portion of the front barrel 3. An annular locking portion 3*d* for attaching the base portion of the brush tip 6, which serves as an application member is formed on the inside of the air vent holes 3*c* and slightly at the front end side.

A concavo-convex portion 3*e* having different diameters from front to rear is formed in the portion immediately in front of the brim 3*a* that reaches the maximum diameter of the tapered portion, and the opening of the cap 2 is fitted to this concavo-convex portion 3*e* to attach the cap 2 to the barrel 4. As shown in FIG. 1A, the cap 2 is connected to the rear barrel 1 in a straight line, thereby becoming an elongated cylinder in appearance.

A male thread 3*f* is formed immediately after the brim 3*a* of the front barrel 3, and this male thread 3*f* causes the latter half of the front barrel 3 to be screwed into the rear barrel inner layer 1*a* of the rear barrel 1 to connect the front barrel 3 and the rear barrel 1, thereby forming the barrel 4.

Most of the space from immediately after the air displacement hole 3*c* to the rear part of the front barrel 3 constitutes the housing space 3*g* for the collector 8.

Furthermore, an annular protrusion 3*h* protruding along the inner circumference is formed slightly behind the opening at the rear end of the front barrel 3, and when the application liquid reservoir 12 is installed from the rear end of the front barrel 3, a circular locking protrusion 12*a* (see FIG. 4) formed on the circumference of the liquid reservoir 12 climbs over the annular protrusion 3*h*, thereby allowing the application liquid reservoir 12 to be attached to the rear end of the front barrel 3.

In a state where the collector 8 and the application liquid reservoir 12 are mounted inside the front barrel 3, the front end of the application liquid reservoir 12 and the collector 8 are arranged to provide a suitable clearance therebetween (see FIGS. 1A and 1B to FIGS. 3A and 3B).

The front barrel 3 is preferably molded from a transparent resin material, such as polycarbonate. This point will be explained later.

Brush Tip (Application Member) 6

From the front end opening 3*b* of the front barrel 3 (see FIGS. 3A and 3B), a tapered tip of the brush tip 6 as an application member protrudes, and the tip end angle of the brush tip 6 should be formed to be approximately the same angle as the tip end angle of the tapered front 3.

As shown in FIG. 3A, the brush tip 6 has a hollow portion 6*a* formed on the rear half side, and the tip end 11*b* of the application liquid supply tube 11 which is provided with a linear axial hole 11*a* inside the hollow portion 6*a* is inserted therein. Thus, the application liquid in the application liquid reservoir 12 is sufficiently supplied to the brush tip 6 through the application liquid supply tube 11.

The brush tip 6 is formed by bundling fibers such as natural fibers or resin fibers, and the base portion at the rear end thereof constitutes a disc-like flange portion 6*b* by expanding the inner diameter. In order to attach the brush tip 6 to the front barrel 3, the tip end of the brush tip 6 is inserted through the rear opening of the front barrel 3, fed directly into the front barrel 3, and the tip end of the brush tip 6 is drawn through the front end opening 3*b* of the front barrel 3.

In this state, the collector 8 is accommodated in the collector accommodating space 3*g* of the front barrel 3 from the rear of the front barrel 3, whereby the bowl-shaped portion 8*a* of the collector 8, which will be explained later, abuts against the flange 6*b* formed at the base of the brush tip 6 from the rear.

Thus, the disc-shaped flange portion 6*b* is supported in the front barrel 3 in a state of being sandwiched by the locking portion 3*d* in the front barrel 3 and the bowl-shaped portion 8*a* of the collector 8.

In this case, as shown in FIG. 3A, the brush tip 6 is set in a state in which sufficient space is formed between the brush tip 6 and the front end opening 3*b* of the front barrel 3, i.e., D1>D2, where D1 is the inner diameter of the front end opening 3*b* of the front barrel 3 and D2 is the outer diameter of the brush tip 6 located at the front end opening 3*b*. The action and the effect of this configuration will be described later.

Collector 8

A collector 8 is supported and covered by the barrel 4 comprising the front barrel 3 and the rear barrel 1. In the collector 8, as shown in FIGS. 7A and 7B and FIGS. 8A to 8E, the bowl-shaped portion 8*a* is formed at the tip end in the axial direction, and an application liquid holding portion 9 is formed to have a larger diameter than the temporary holding portion 8*b*. In the collector 8, at the central portion between the bowl-shaped portion 8*a* and the application liquid holding portion 9, the temporary holding portion 8*b* in which multiple comb-shaped fins (leaf-shaped members) are arrayed with separation is formed at multiple positions.

A supporting wall 8*h* having a larger thickness than that of the fins of the temporary holding portion 8*b* is formed between each of the plurality of temporary holding portions 8*b* arranged in the axial direction in the collector 8. The temporary holding portion 8*b* has a larger diameter than that of the bowl-shaped portion 8*a* and the application liquid holding portion 9 is formed to have a larger diameter than that of the temporary holding portion 8*b* and the supporting wall 8*h*. It is constructed so that the bowl-shaped portion 8*a* is fitted into the tapered front portion of the front barrel 3 and the application liquid holding portion 9 is fitted into the rear portion of the front barrel, thereby fixing the collector 8 in the collector accommodating space 3*g* in the front barrel 3.

An application liquid supply tube 11 is provided in the collector 8. In the embodiment, a tubular portion 8*e* having a cylindrical shape and being formed of a wall without holes is formed near the axial center of the collector 8, and a hollow portion 8*d* penetrating along the axial center is formed in the tubular portion 8*e*.

On the outer circumference of the wall of the tubular portion 8*e* having the hollow portion 8, multiple fins (leaf-shaped members) formed with thin plates expanding radially outwardly are arranged in a comb-tooth shape and the temporary holding portion 8*b* serving to temporarily hold the application liquid between the fins is formed.

The collector 8 is for mounting the application liquid supply tube 11, which causes the application liquid to flow near the axial center thereinside, to the hollow portion 8*d* located inside the tubular portion 8*e*. The multiple fins (forming the temporary holding portion 8*b*) in the comb-tooth shape are provided on the outer circumference of the tubular portion 8*e*. The tubular portion 8*e* is a wall without holes in which there are no penetrating holes through the wall throughout the inner and the outer circumferences.

The tip end 11*b* of the application liquid supply tube 11 is fitted into the hollow portion 6*a* in the brush tip 6 as an application member. The application liquid in the application liquid reservoir 12 is supplied through the application liquid supply tube 11 which is inserted into the tubular portion 8*e* in the collector 8.

In the collector 8, a slit 8*g* is formed as a longitudinal groove for introducing the application liquid into the gaps between the fins, which is exposed at the rear end (which can be exposed to the application liquid reservoir 12 side) from the temporary holding portion 8*b* to the application liquid holding portion 9. A thick supporting wall 8*h*, which abuts against the inner surface of the front barrel 3, adequately separates the blocks composed of a plurality of fins in the temporary holding portion 8*b*. Specifically, the number of fins in the temporary holding portion 8*b* is 40 to 60 as a whole, and the space between the fins may be 0.15 mm to 0.3 mm.

The collector 8 and the application liquid supply tube 11 are preferably formed of resin material, together with the application liquid holding portion 9 to be described later.

Application Liquid Holding Portion 9

The application liquid supply tube 11 does not protrude into the application liquid reservoir 12 from the application liquid holding portion 9 provided at the rear portion of the collector 8. However, the space 9*k* inside the application liquid holding portion 9 faces the tip end of the opening of the application liquid reservoir 12, which is a construction allowing the application liquid to sufficiently extend into the application liquid holding portion 9 and application liquid supply tube 11.

The outer circumferential surface (protrusions 9*b*) of the application liquid holding portion 9 provided at the rear portion of the collector 8 is in fluid-tight contact with the inner wall of the front barrel 3.

In detail, a sealing portion with the front barrel 3 (barrel 4) is provided on the outer circumferential surface of the front end of the application liquid holding portion 9, and a fitting portion 9*c* is formed to prevent the front barrel 3 (barrel 4) from coming off is formed on the outer circumferential surface of the rear end portion. The application liquid holding portion 9 at the rear portion of the collector 8 is fitted into the inner surface of the front barrel 3 to fix the collector 8 to the front barrel 3.

As shown in FIGS. 7A and 7B and FIGS. 8A to 8E, the application liquid holding portion 9 is formed continuously to the rear end portion of the temporary holding portion 8*b* and the tubular portion 8*e*. That is, the application liquid holding portion 9 has a wall-like base portion 9*a* formed at the rear end of the tubular portion 8*e* in a disc-shaped manner and extending in diameter and a concentric and approximately cylindrical outer wall portion 9*g* and an inner wall portion 9*e* extending rearwardly from the proximal portion 9*a*.

The outer wall portion 9*g* and the inner wall portion 9*e* form an approximately cup shape with a space 9*k* therebetween. The space 9*k* has a holding function of the application liquid and the holding amount of the application liquid is preferably from 20 mg to 40 mg.

An opening groove 9*g*1 and an opening groove 9*e*1 are formed on the outer wall portion 9*g* and the inner wall portion 9*e*, respectively, to enlarge the space 9*k*. The opening groove 9*g*1 of the outer wall portion 9*g* is formed at one position along the axial direction on the same side and continuous with the slit 8*g*.

A protrusion 9*b* formed in an annular rib shape is formed, which protrudes outwardly near the outer circumference of the base 9*a*, on the outer wall portion 9*g* of the application liquid holding portion 9. The protrusion 9*b* serves as a seal for maintaining fluid tightness when fitted into the inner circumferential surface of the front barrel 3 (barrel 4).

The opening groove 9*e*1 is formed on the inner wall portion 9*e* at two positions on the same and opposite sides of the slit 8*g*. The inner diameter of the inner wall portion 9*e* is such that the rear end portion of the application liquid supply tube 11 is tightly attachable. For example, the inner diameter thereof can be the same as the inner diameter of the hollow portion 8*d* in the tubular portion 8*e*.

The cosmetic applicator according to the present embodiment is a collector-type applicator. In the cosmetic applicator, the application liquid flows into the application liquid holding portion 9 by directing the tip end of the brush tip 6 as an application member downward. In the cosmetic applicator, the application liquid filled in the application liquid holding portion 9 is held by the surface tension without falling downward, when the brush tip 6 is directed upward.

Thus, in the case of upward application or when the brush tip is dried during storage, the application liquid held in the space 9*k* of the application liquid holding portion 9 is supplied to the application liquid supply tube 11 through the opening grooves 9*e*1 and 9*g*1.

When multi-pore material is arranged in the application liquid holding portion 9, the contact area between the application liquid and the application liquid holding portion 9 is small. In the case of a low surface tension liquid, it is feared that the liquid may not be held due to a low holding force, or the supply of the liquid to the application portion may be insufficient depending on the material used. In the present embodiment, the contact area between the application liquid and the application liquid holding portion 9 can be increased by providing an inner wall (inner wall portion 9*e*), thereby easily holding even the low surface tension liquid.

Application Liquid Reservoir 12

The application liquid reservoir is cylindrical in shape with one end (the bottom) closed and is preferably supplied as a replaceable cartridge.

By inserting the application supply side of the application liquid reservoir 12 into the rear end portion of the front barrel 3, the locking protrusion 12*a* formed on the side of the application liquid reservoir 12 (see FIG. 4) overcomes the annular protrusion 3*h* formed in the front barrel 3 (see FIGS. 6A and 6B), and the application liquid reservoir 12 is mounted.

The application liquid reservoir 12 does not contain an impregnant such as padding but directly contains the application liquid, and also the agitator 12*c* for agitating the application liquid is contained and arranged.

The application liquid reservoir 12 is molded of a resin material, and the agitator 12*c* may use a ball material made of metal or resin.

Liquid Cosmetic

An example of preferred liquid cosmetics to be used in the cosmetic applicator according to the present invention will be described.

The liquid cosmetic to be used in the present cosmetic applicator is designed to include at least brilliant particles having a major axial length of 10 μm to 50 μm, brilliant particles having a major axial length of 50 μm to 100 μm, and water, and the viscosity is set to be less than 25 mPa·s.

The brilliant particles are platy pigments whose surfaces are coated with chemical compounds. The platy pigments are those whose surfaces are coated with chemical compounds such as a pearl pigment, an aluminum flake pigment (aluminum powder pigment), metal- or metal oxide-coated glass flakes, and aluminum coated polyester film, and, further, platy pigments whose surfaces are coated with e.g., cellulose, hemicellulose, lignin, chitin, chitosan. By combining a plurality of brilliant pigments, a combination of 0.5% to 5% of brilliant particles having a major axial length of 10 μm to 50 μm and 0.2% to 5% of brilliant particles having a major axial length of 50 μm to 100 μm, for example, more vivid brilliant coatings are easily obtained. If the amount of ingredients is less than the above numerical range, it is difficult to obtain sufficient brilliance during coating, and if it is exceeded, the evaluation by liquid outflow amount becomes difficult.

Furthermore, acrylic copolymers are preferred from the point of view of fixation and dispersion stability. As acrylic copolymers to be used, e.g., containing at least one of the following: alkyl acrylate copolymer, acrylate copolymer, ammonium acrylate copolymer, acrylic resin alkanolamine solution, alkyl acrylate/vinyl acetate copolymer, acrylates/VA copolymer, (alkyl acrylate/octylacrylamide) copolymer silicone-modified acrylic copolymer, and octyl acrylamide/acrylic acid copolymer.

The acrylic copolymer used should be acrylic alkyl copolymer or acrylate copolymer, etc., as these are preferred from the point of view of further enhancing the effect and improving adhesion.

Examples of alkyl acrylate copolymers include (octylacrylamide/hydroxypropyl acrylate/butylaminoethyl methacrylate) copolymer (product name: Amphomer, powder) and ammonium alkyl acrylate copolymer (product name: Yodosol GH800F, 45% solids).

For neutralization, 2-amino-2-methyl-1-propanol, 2-amino-2-methyl-1,3-propanediol, triethanolamine, L-arginine, aqueous ammonia, sodium hydroxide, etc. can be used, and 2-amino-2-methyl-1-propanol is particularly preferred.

The content of these acrylic copolymers should be 1-20% by weight of the total composition.

If the content of these acrylic copolymers is less than 1%, it will be difficult to achieve the effects of the present invention, while if it exceeds 20%, the thickening effect will be too strong, and it will not be possible to achieve good coating, etc., such as discharge from the application part.

In addition to the above ingredients, the rest of the liquid cosmetic composition is prepared using water (purified water, ion-exchanged water, distilled water, pure water, etc.) as a solvent.

In addition, humectants, antibacterial agents, defoamers, inorganic pigments, organic pigments, dyes, surfactants, and water-soluble organic solvents may be added as needed without causing any problems with the dispersion system and without impairing the effects of the present invention.

Humectants that can be used include, for example, water-soluble glycols such as 1,3-butylene glycol, 1,4-butylene glycol, pentylene glycol, ethylene glycol, diethylene glycol, polyethylene glycol, propylene glycol, dipropylene glycol, and glycerin.

These humectants are used in the composition in an amount of 1-30%, preferably 5-20%, of the total composition.

Examples of antibacterial agents that can be used include parabens, sodium dehydroacetate, and phenoxyethanol. The antibacterial agents of this invention include preservatives, and methylparaben, ethylparaben, propylparaben, butylparaben, isopropylparaben, etc. can be used in appropriate quantities as preservatives.

An example of a defoamer that can be used is polydimethylsiloxane (dimethicone). This polydimethylsiloxane is a silicone oil consisting of a mixture of linear siloxane polymers with trimethylsiloxane units at the ends.

The pH of liquid cosmetic compositions should be in the range of 6 to 9 in order to suppress skin irritation. To adjust the pH, pH adjusters such as 2-amino-2-methyl-1-propanol, 2-amino-2-methyl-1,3-propanediol, triethanolamine, L-arginine, ammonia water, sodium hydroxide, citric acid solution, etc. can be used.

Figure 9A:
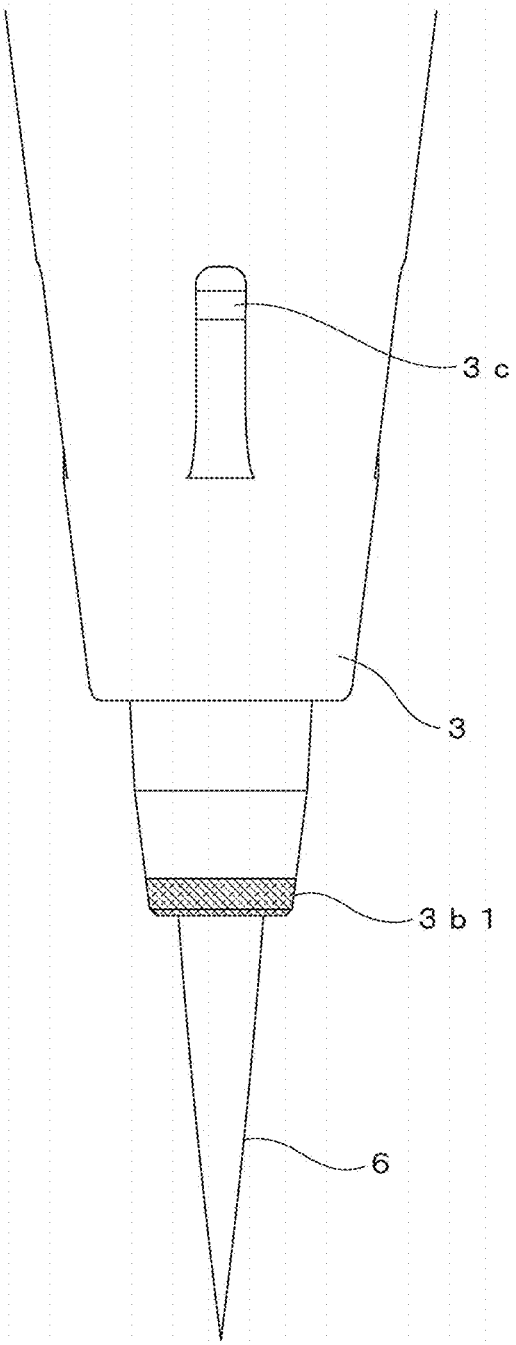
FIGS. 9A and 9B are enlarged appearance views.
Figure 9B:
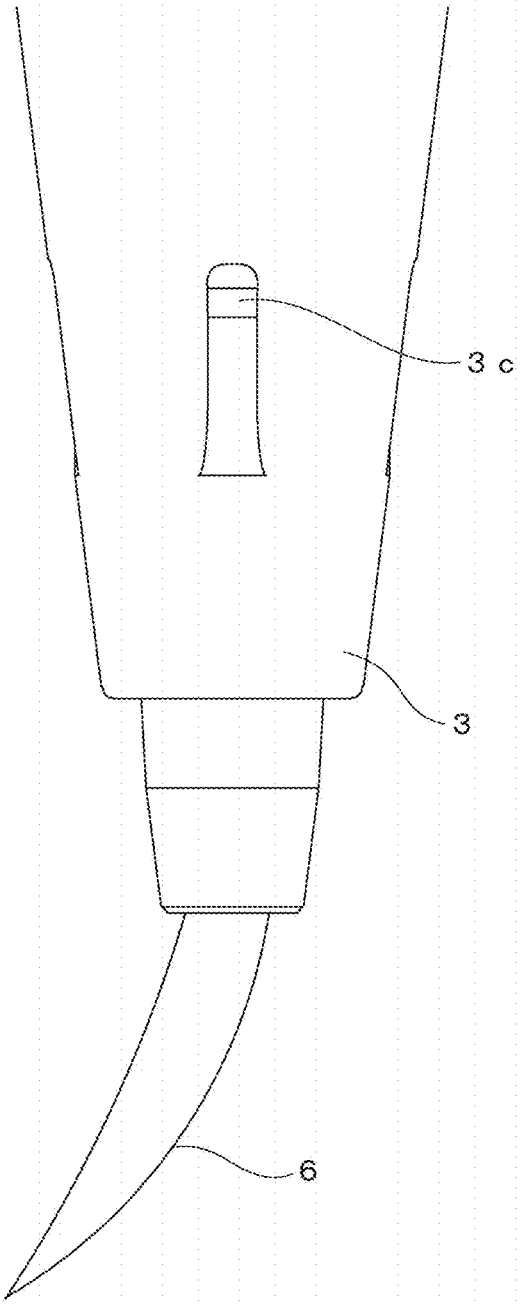

FIGS. 9A and 9B illustrate the application action of the application liquid in the cosmetic applicator described above.

As shown in FIG. 9A, the brush tip 6, which protrudes from the front opening 3*b* of the front barrel 3, maintains a straight line along the barrel when it is not in use, i.e., when it is not applying the application liquid. It is also well known that the brush tip 6 deflects and deforms when the application liquid is applied, as shown in FIG. 9B.

As described based on FIG. 3A, the cosmetic applicator of the present invention has a brush tip 6 between the front opening 3*b* of the front barrel 3 and the brush tip 6, a clearance (shown by the same symbol 3*b* as the front opening) is formed which is sufficient to allow the deflection deformation to be transferred to the brush tip 6 within the front barrel 3, along with the deflection deformation of the brush tip 6 by the application action of the application liquid using the brush tip 6.

Therefore, the fibers forming the brush tip 6 inside the front barrel 3 without maintaining a close contact state, and shearing between the fibers occurs by the deflection and the deformation of the brush tip 6 in the same manner as the front half of the brush tip 6. Thus, it is possible to continue stable application operations without clogging the brush tip 6 with particles in the application liquid.

Meanwhile, by forming the front barrel with transparent material, the state of the space between the front end opening 3*b* of the front barrel 3 and the brush tip 6 can be observed as follows.

That is, when the brush tip 6 is directed downward as shown in FIG. 9A, the application liquid accumulates in the space between the front opening 3*b* of the front barrel and the brush tip 6, it can be observed that a pooling indicated by a reference sign of 3*b*1 of the application liquid is formed at the front end of the front barrel 3.

When the brush tip 6 is deflected and deformed by the application operation, the brush tip 6 in the front opening 3*b* is also deflected and deformed and the application liquid between the front end opening 3*b* and the brush tip 6 is consumed, and then, the pooling of the application liquid indicated by a reference sign of 3*b*1 disappears. That is, by repeating the application operation, the occurrence and the disappearance of the pooling of the application liquid 3*b*1 at the front end of the front barrel 3 are repeated.

In other words, the repetition of occurrence and disappearance of the application liquid pool 3*b*1 can be understood to indicate that the brush tip 6 inside the front barrel 3 is deflected and deformed, thereby preventing clogging of the application liquid particles throughout the brush tip 6 and enabling stable application.

More in detail, when the cosmetic is applied to an application surface, the lame (shiny material) moves through the passage in the applicator with the application liquid. When the flow resistance of the cosmetic increases due to the changes in the flow passage at the contact portion between the application liquid supply tube 11 and the brush tip 6 and within the brush tip 6, the lame stagnates on the wall surface of the flow passage and the flow passage is narrowed. As the narrowing of the flow passage caused by the particles progresses one after another, it blocks the flow passage, resulting in a decrease in the amount of cosmetic that flows out and, in turn, a decrease in the brightness of the drawn lines.

To prevent clogging with the lame, it is effective to prevent the lame from sticking to each other and from sticking to the wall of the flow passage. In particular, to prevent the particles from sticking to the fibers of the brush tip 6, it is effective to keep the particles moving fluidly against the fibers. This reduces the frequency with which the particles stick to the wall, and reduces the particle adhesion that leads to narrowing of the flow passage.

In the case of a liquid-dispensing eyeliner in which the brush tip 6 is an application portion, attention is paid to the fact that the brush tip 6 deflects during the application, and the deflection amount of the brush tip is made larger when the brush tip comes into contact with the application surface. In order to make the lame-containing liquid cosmetic move more against the brush tip 6 within the brush tip 6, a diameter difference (clearance), D1–D2, is created between the inner diameter D1 of the front end opening 3*b* of the front barrel 3 and the outermost diameter D2 of the brush tip 6 located on the front end opening 3*b* of the front barrel 3.

When the brush tip 6 deflects by being pressed against the application surface, the deformation amount of the fibers of the brush tip 6 is inhibited by the brush tip 6 contacting the front end opening 3*b* of the front barrel 3. By increasing the clearance D1-D2, the distance until the brush tip 6 can reach the wall of the front barrel can be increased, allowing the brush tip 6 to deflect more.

When the brush tip 6 is deflected, the cosmetic stored in the brush tip 6 and also the particles contained in the cosmetic are displaced along with the deformation of the brush tip 6. Since the displacement of the cosmetics stored in the brush tip 6 can be increased by increasing the deflection of the brush tip, the particles become difficult to clog and the deterioration of the brilliance of the lame and the decrease of the flow amount of the cosmetics can be inhibited.

On the cross section of the brush tip 6 at the outer diameter D2 of the brush tip located at the front end opening 3*b* of the front barrel 3, that is, on the cross section of the brush tip 6 indicated by the b-b line in FIG. 3A, as shown in FIG. 3B, it is preferred that the ratio of the void area, Sr, which is the ratio (Sb/Sa) of the cross-sectional area Sb of the hollow portion 6*a* formed at the brush tip 6 to the cross-sectional area Sa surrounded by the outer circumference of the brush tip 6 is 40%<Sr<95%.

EXAMPLES

The parameters in the invention are denoted as D1 [mm], which is the inner diameter of the front end opening 3*b* of the front barrel 3, D2 [mm], which is the outer diameter of the brush tip 6 located at the front end opening 3*b* of the front barrel 3, and D3, which is the ratio of the difference between the inner diameter D1 of the front end opening 3*b* and the outer diameter D2 of the brush tip 6, to D2. As for the measurement of the parameters, the diameter D1 of the front end opening 3*b* of the front barrel 3 was measured by the pin gauges, and the diameter of the brush tip D2 was measured by a microscope VHX-8000 manufactured by KEYENCE CORPORATION.

The cosmetic contains three kinds of lame ingredients of 4 wt. % of pearl pigment having an average diameter of 20 μm, 1 wt. % of glass flake having an average diameter of 30 μm, and 0.5 wt. % of glass flake having an average diameter of 20 μm. A brown aqueous cosmetic having a viscosity of 5 mPa·s (50 rpm) and a surface tension of 37 mN/m was filled in a cosmetic applicator and applied to a non-absorbable urethane sheet while holding the applicator horizontally. The brightness feeling of the lame applied to the urethane sheet for a certain number of brushes was visually evaluated by the inventor. It is noted that the average diameter is a value calculated based on the measurement by the dynamic light scattering method (Diameter Analyzer FPAR-1000, manufactured by Otsuka Electronics Co., Ltd.). The viscosity was measured by the cone-plate type viscometer (TV-20, manufactured by TOKIMEC (now TOKYO KEIKI INC.)) and the surface tension was measured by the automatic surface tensiometer (DY-300, manufactured by Kyowa Interface Science Co., Ltd.), both under the environmental condition of a temperature of 25° C. and a humidity of 60%. The measured values of the physical properties of the cosmetic were rounded to the decimal point.

Examples and comparative examples of the evaluation of the drawn line brightness on the aforementioned parameters are shown in Table 1.

The standard of evaluation is as follows:

A: No brightness degradation was observed at 1000 brushes or more,

B: Brightness degradation observed on less than 800 brushes,

C: Brightness degradation observed on less than 600 brushes,

D: Brightness degradation observed on less than 400 brushes, and

E: Brightness degradation observed on less than 200 brushes.

TABLE 1

| | D1 | D2 | D3 | Evaluation |
|---|---|---|---|---|
| Example 1 | 1.75 | 1.4 | 0.25 | A |
| Example 2 | 2 | 1.4 | 0.43 | A |
| Example 3 | 2 | 1.6 | 0.25 | A |
| Example 4 | 2.8 | 2.2 | 0.27 | A |
| Example 5 | 2.8 | 2 | 0.40 | A |
| Comparative Example 1 | 1.5 | 1.4 | 0.07 | D |
| Comparative Example 2 | 1.6 | 1.4 | 0.14 | C |
| Comparative Example 3 | 1.75 | 1.6 | 0.09 | C |
| Comparative Example 4 | 1.5 | 1.6 | −0.06 | E |
| Comparative Example 5 | 1.6 | 1.6 | 0.00 | E |
| Comparative Example 6 | 2.8 | 2.6 | 0.08 | E |
| Comparative Example 7 | 2.8 | 2.4 | 0.17 | E |
| Comparative Example 8 | 2.2 | 2.2 | 0.00 | E |
| Comparative Example 9 | 2.2 | 2 | 0.10 | E |
| Comparative Example 10 | 2.2 | 2.6 | −0.15 | E |
| Comparative Example 11 | 2.2 | 2.4 | −0.08 | E |

In the present invention, the cosmetic may be a black aqueous eyeliner cosmetic without containing three kinds of lame ingredients as brilliant particles but containing 8 wt. % carbon black as a carbon-based black pigment having an average diameter of 1,000 nm, a viscosity of 5 mPa·s (50 rpm), and a surface tension of 35 mN/i. The evaluation method is the same as described above.

TABLE 2

| | D1 | D2 | D3 | Evaluation |
|---|---|---|---|---|
| Example 101 | 1.75 | 1.4 | 0.25 | A |
| Example 102 | 2 | 1.4 | 0.43 | A |

TABLE 2-continued

| | D1 | D2 | D3 | Evaluation |
|---|---|---|---|---|
| Example 103 | 2 | 1.6 | 0.25 | A |
| Example 104 | 2.8 | 2.2 | 0.27 | A |
| Example 105 | 2.8 | 2 | 0.40 | A |
| Comparative Example 101 | 1.5 | 1.4 | 0.07 | C |
| Comparative Example 102 | 1.6 | 1.4 | 0.14 | B |
| Comparative Example 103 | 1.75 | 1.6 | 0.09 | B |
| Comparative Example 104 | 1.5 | 1.6 | −0.06 | D |
| Comparative Example 105 | 1.6 | 1.6 | 0.00 | D |
| Comparative Example 106 | 2.8 | 2.6 | 0.08 | D |
| Comparative Example 107 | 2.8 | 2.4 | 0.17 | D |
| Comparative Example 108 | 2.2 | 2.2 | 0.00 | D |
| Comparative Example 109 | 2.2 | 2 | 0.10 | D |
| Comparative Example 110 | 2.2 | 2.6 | −0.15 | D |
| Comparative Example 111 | 2.2 | 2.4 | −0.08 | D |

LIST OF REFERENCE SIGNS

1 rear barrel
1*a* rear barrel inner layer
2 cap
2*a* cap inner layer
3 front barrel
3*a* brim
3*b* front end opening
3*b*1 application liquid pool
3*f* male thread
3*g* collector accommodation space
4 barrel
6 brush tip (application member)
6*a* hollow portion
6*b* flange portion
8 collector
9 application liquid holding portion
11 application liquid supply tube
11*a* axial hole
12 application liquid reservoir
12*c* stirrer
D1 inner diameter of the front end opening of the front barrel
D2 outer diameter of the brush tip located at the front end opening

What is claimed is:

1. A cosmetic applicator, comprising:

a barrel comprising a front barrel and a rear barrel;

an application member comprising a brush tip comprising a bundle of fibers on a front barrel side of the barrel;

an application liquid as a liquid cosmetic; and an application liquid reservoir comprising the application liquid, disposed at a rear barrel of the barrel, and configured to supply the application liquid in the application liquid reservoir to the brush tip, wherein the front barrel is made of a transparent material wherein the brush tip is mounted within the front barrel, a tip portion of the brush tip being arranged to protrude from the front barrel through a front end opening of the front barrel, wherein a clearance is formed between the front end opening of the front barrel and the brush tip, allowing the brush tip in the front barrel to also be deflected and deformed together with the deflection deformation of the brush tip due to the application operation of the application liquid with the brush tip, and wherein the cosmetic applicator satisfies:

$$1\ \text{mm} \le D2 < D1 \le 3\ \text{mm}, \quad (1)$$

$$0.25 \le D3, \quad (2)$$

D1 being an inner diameter of the front end opening of the front barrel, D2 being an outer diameter of the brush tip located at the front end opening of the brush tip, and D3=(D1−D2)/D2, and (3) a ratio of areas, Sr=Sb/Sa, is 40%<Sr<95%. Sa being a cross-sectional area surrounded by the outer circumference of the brush tip at the outer diameter D2 of the brush tip located at the front end opening of the front barrel, and Sb is the cross-sectional area of the hollow portion formed at the brush tip.

2. The cosmetic applicator of claim 1, satisfying:

$$0.27 \le D3. \quad (2)$$

3. The cosmetic applicator of claim 1, comprising a cosmetic comprising:

pearl pigment having an average diameter of 20 μm, in 4 wt. %;

glass flake having an average diameter of 30 μm, in 1 wt. %; and glass flake having an average diameter of 20 μm, in 0.5 wt. %; and a brown aqueous cosmetic having a viscosity of 5 mPa's at 50 rpm and a surface tension of 37 mN/m.

4. The cosmetic applicator of claim 1, comprising a black aqueous eyeliner cosmetic comprising carbon black having an average diameter of 1,000 nm, a viscosity of 5 mPa's at 50 rpm, and a surface tension of 35 mN/m, in 8 wt. %.

5. The cosmetic applicator of claim 1, satisfying:

$$0.43 \le D3. \quad (2)$$

6. The cosmetic applicator of claim 1, wherein the brush tip has a hollow portion formed on a rear half side of the brush tip.

7. The cosmetic applicator of claim 1, comprising a liquid cosmetic.

8. The cosmetic applicator of claim 1, comprising a cosmetic comprising first brilliant particles having a major axial length in a range of from 10 to 50 μm.

9. The cosmetic applicator of claim 8, wherein the cosmetic further comprises second brilliant particles having a major axial length in a range of from 50 to 100 μm.

10. The cosmetic applicator of claim 9, wherein the cosmetic is a liquid cosmetic.

11. The cosmetic applicator of claim 1, comprising a liquid cosmetic comprising first brilliant particles having a major axial length in a range of from 10 to 50 μm, second brilliant particles having a major axial length in a range of from 50 to 100 μm, and water.

12. The cosmetic applicator of claim 8, wherein the first brilliant particles are present in a range of from 0.5 to 5 wt. %, based on a total cosmetic weight.

13. The cosmetic applicator of claim 9, wherein the second brilliant particles are present in a range of from 0.2 to 5 wt. %, based on a total cosmetic weight.

14. The cosmetic applicator of claim 11, wherein, based on a total liquid cosmetic weight, the first brilliant particles are present in a range of from 0.5 to 5 wt. %, and the second brilliant particles are present in a range of from 0.2 to 5 wt. %.

15. The cosmetic applicator of claim 8, wherein the first brilliant particles comprise pearl pigment.

16. The cosmetic applicator of claim 1, wherein the first brilliant particles comprise aluminum pigment.

17. The cosmetic applicator of claim 1, wherein the first brilliant particles comprise metal-coated glass.

18. The cosmetic applicator of claim 1, wherein the first brilliant particles comprise metal-oxide-coated glass.

19. The cosmetic applicator of claim 1, satisfying:

$$\leq D2 < D1, \quad (1)$$

wherein

D1 is in a range of from 1.75 to 2.8 mm, and

D2 is in a range of from 1.4 to 2.2 mm.

20. The cosmetic applicator of claim 19, wherein D3 is in a range of from 0.25 to 0.40.

* * * * *